United States Patent [19]

Habele et al.

[11] Patent Number: 4,905,842

[45] Date of Patent: Mar. 6, 1990

[54] SORTING DEVICE

[75] Inventors: Michael Habele, Waldenbuch; Jakob Zeyda, Leinfelden-Echterdingen, both of Fed. Rep. of Germany

[73] Assignee: Robert Bosch GmbH, Stuttgart, Fed. Rep. of Germany

[21] Appl. No.: 143,445

[22] Filed: Jan. 12, 1988

[30] Foreign Application Priority Data

Feb. 28, 1987 [DE] Fed. Rep. of Germany ..... 3706575

[51] Int. Cl.[4] ..... B07C 5/00

[52] U.S. Cl. ..... 209/557; 209/556; 209/586; 209/929

[58] Field of Search ..... 209/567, 555, 557, 556, 209/558, 525, 629, 632, 633, 539, 920, 929, 586; 198/389, 524

[56] References Cited

U.S. PATENT DOCUMENTS

| | | | |
|---|---|---|---|
| 3,091,332 | 5/1963 | Parker | 209/557 X |
| 3,539,006 | 11/1970 | Hanna | 209/555 |
| 3,709,328 | 1/1973 | Mohr et al. | 209/586 |
| 4,174,028 | 11/1979 | Barnes | 198/526 X |
| 4,454,947 | 6/1984 | Jacobsmeyer et al. | 209/555 X |
| 4,457,622 | 7/1984 | Kato et al. | 209/586 X |

*Primary Examiner*—Kevin P. Shaver

*Attorney, Agent, or Firm*—Michael J. Striker

[57] ABSTRACT

Disclosed is a device for sorting fasteners, particularly screws, wherein defective fasteners are identified by a series of mechanical and electrical gauging stations arranged one after the other on a rectilinear conveying track and controlling ejection devices for eliminating screws which are not true in size or in quality. The mechanical gauging stations precede the electrical ones operating on the eddy current principle, in order to prevent neutralization of error signals generated by the electrical gauging stations. In this manner a very high accuracy of the entire sorting device is achieved.

18 Claims, 3 Drawing Sheets

SORTING DEVICE

BACKGROUND OF THE INVENTION

The present invention relates to a sorting device for fastening components having heads, particularly screws, moving on a conveying device.

Known is a sorting device wherein the screws to be sorted are transported on a conveyor band past an opto-electronic sensor, particularly past a row of CCD-sensors equipped with photodiodes. By means of a projection lamp, a shadow of respective screws is projected on the sensor and the shadow image is compared with desired or standard dimensions. When the projected shadow contour of the screw shows a defect, the resulting error signal activates a group of nozzles which blow off the screw from the conveyor belt. This prior art sorting device has the disadvantage that during the gauging the projected shadow can be tested in single plane only. Consequently, defects on the non-projected circumferential portions on the end surface or in recessed parts (in the slot configuration) cannot be recognized. Moreover, the measuring accuracy is dependent on the conveying speed at the measuring point and on the stable position of the screw on the conveyor band.

SUMMARY OF THE INVENTION

It is therefore a general object of the present invention to overcome the aforementioned disadvantages.

More particularly, it is an object of the invention to provide an improved sorting device which in comparison with prior art devices of this kind has the advantage of increased accuracy in gauging the entire shape of the screws, that means both their configuration and dimensions, quality of their upper surface as well as the condition of recessed parts (slots, cracks).

In addition, an object of this invention is to provide such an improved sorting device which is not affected by the speed of transportation of the conveying device.

In keeping with these objects and others which will become apparent hereafter, one feature of the invention resides in the provision of a conveyor having a linear track, a plurality of mechanical and electrical gauging stations arranged in the path of the fasteners on the conveyor to detect fasteners which are not accurate in size, and ejection devices for separating the detected fasteners.

In contrast to prior art optical gauging methods, the measurement in the device of this invention is not impaired by contaminating particles. Also, temperature effects are negligible. Moreover, the sorting device of the invention is substantially less expensive than the known optical systems. For example, the conveying device can be in the form of a simple rail provided with a linear conveyor. Due to the combination of mechanical and electrical measuring stations, the reliability of the sorting device is substantially improved.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawing.

DESCRIPTION OF THE PREFERRED EMBODIMENTS

Figure 1:
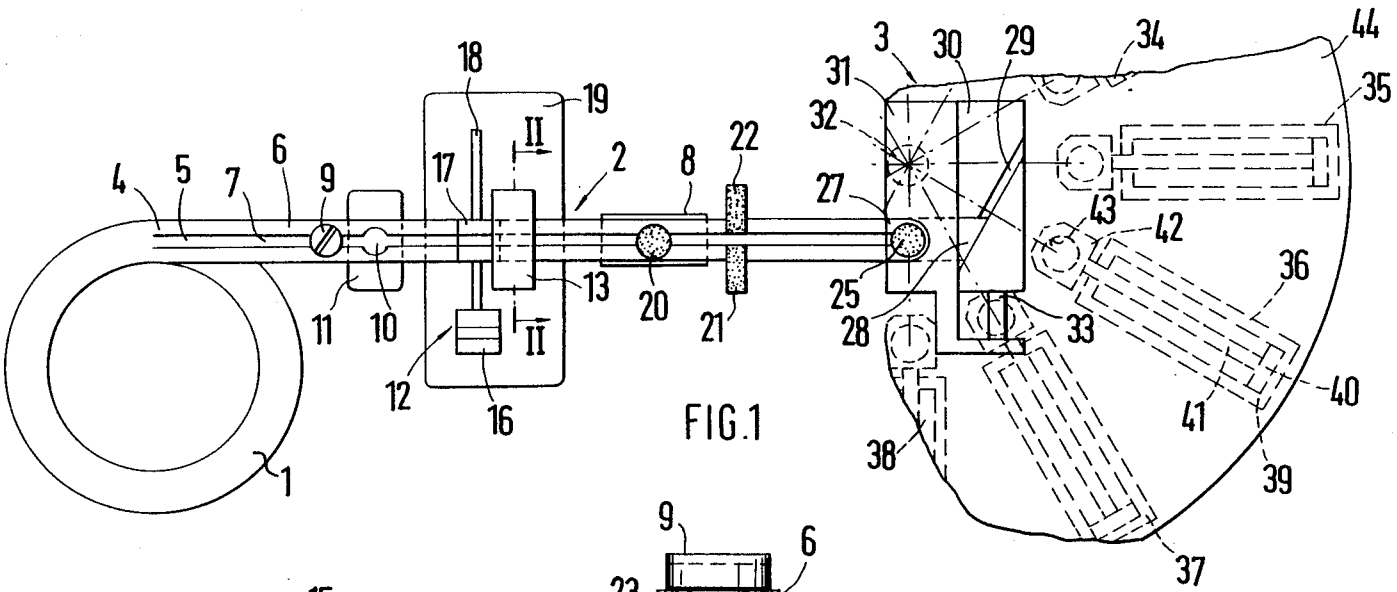
FIG. 1 shows a plan view of the entire sorting device of this invention.

The sorting device shown in FIG. 1 is assembled of two main parts, namely of a conveyor supply container 1 for feeding series of fasteners on a conveying linear track 2 provided with devices for identifying and rejecting defective screws on the conveying track. A separating device 3 or at least screw spindle or a non-illustrated packing machine are located at the outlet of the conveyor track 2.

The supply container 1 whose construction is known from prior art, contains as a bulk material the screws, nails, bolts or other fasteners formed with a head and a shank and discharges the same in a series onto a slotted inlet rail 4 from which the fasteners are suspended. The slot 5 of the inlet rail 4 permits the passage of the shanks of respective screws but prevents the passage of the heads. The inlet rail 4 transits continuously into a rectilinear slotted rail 6 of the same configuration having a slot 7 corresponding to the slot 5. The rail 6 pertains to a rectilinear conveying track 2 which is firmly connected to a vibrating linear conveyor 8 which by vibrations imparts to the suspended screws 9 a substantially constant rectilinear movement in the direction of transportation.

The slot 7 at a first gauging station is expanded into a circular hole 10 which is slightly smaller than the standard diameter of the head of the tested screws 9. Screws whose head diameter is smaller than the hole 10 fall into a collecting container 11 for rejected unuseable screws.

Figure 2:
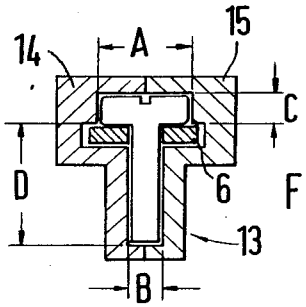
FIG. 2 shows a sectional side view of a gauging template in the device of FIG. 1, taken along the line II—II.

If the head diameter is not smaller than the gauging hole, then the screw 9 is advanced on a switching slider 12 and introduced into a gauging template 13. As illustrated in FIG. 2, the template 13 has the geometry of the screw in regards the diameter A of its head, the diameter B of its shank, the height C of its head and the length D of the shank. The template 13 is assembled of two halves 14 and 15 mounted on opposite sides of the slotted rail 6 and being fastened by non-illustrated screws to the narrow sides of the rail. If the geometry of the screw 9 exceeds one of the above listed dimensions, then the conveyed screws are stopped at the entrance of the template 13.

The switchover slider 12 consists of two short slotted rail pieces 16 and 17 mounted on a transverse rod 18. As it will be explained below, the rail pieces 16 and 17 are alternately shifted into a gap in the rail 6 to align with the slot 7. Another collecting container 19 is located below the switch-over slider 12 to collect the oversized screws which did not pass through the template 13 and which were ejected by the slider 12. Upon the switch-over of the slider 12, the ejected oversized screw is shaken off the projecting rail piece 16 or 17 by the vibrating action of the linear conveyor 8. The switch-over slider 12 receives its switching signal from a regulating device 50 which will be described later on in connection with FIG. 7.

Figure 7:
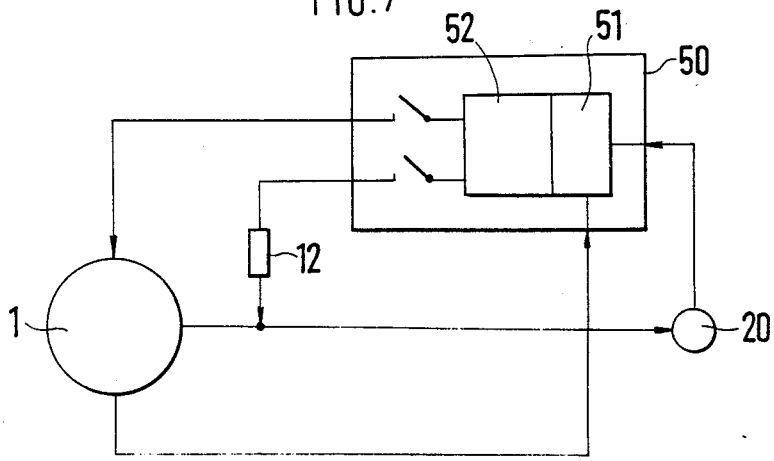
FIG. 7 shows a block circuit diagram of a regulating circuit for the sorting device of this invention.

The screws 9 which pass through the template 13 continue their advance on the linear track 2 and pass a proximity sensor 20 which is arranged above the slotted rail 6. The proximity sensor detects the presence of a transported screw and delivers a corresponding output signal. The proximity sensor is of conventional construction utilizing mechanical, inductive, capacitive, piezoelectric, ultrasonic or eddy-current or other proximity sensing phenomena. The electrical signal from the proximity sensor 20 is applied to an electrical or pneumatic regulating device 50 (FIG. 7).

Figure 3:
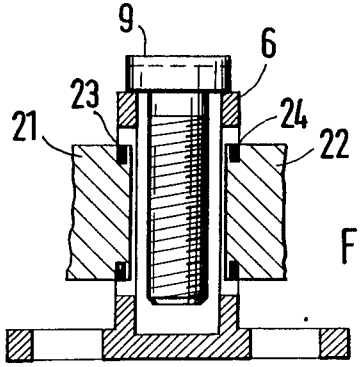
FIG. 3 is a sectional side view of shank sensors in the device of FIG. 1.

A shank sensor 21, 22 is situated downstream of the proximity sensor 20 when viewed in the transporting direction. The shank sensor consists of two opposite parts 21 and 22 provided respectively with coils 23, 24 arranged in corresponding openings in lateral flanks of the slotted rail 6, as illustrated in FIG. 3. Preferably, the coils are designed to operate according to the eddy-current principle as described in the copending German application No. P 37 06 574.2. The eddy-current shank sensor has the advantage that it detects also the defects in the upper surface of the tested material. However, instead of induction coils 23, 24 it is also possible to use electrode plates so that the shank sensor operates as a capacitor.

By means of the shank sensor 21, 22 the following dimensions are monitored: shank diameter, shank length, defects in thread, material defects such as cracks and cavities, and defects in the upper surface, for example a defective treatment of the upper surface. The shank sensor delivers at its output a measuring signal shown by way of an example in the time plot of FIG. 4. In the diagram, the horizontal axis represents time t and the vertical axis indicates the amplitude of the measuring signal. In this example, the amplitudes pertaining to the tested first three screws reach the tolerance range T and therefore are free of defects. The next four screws, however, are defective because the corresponding measuring signal is below the prescribed tolerance range. It will be pointed out however that in the measuring method by means of sensors 23, 24 the detected errors may compensate each other, for example when the shank diameter is too small and the thread is missing or the shank is too long and cavities are present. For this reason, in the device of this invention, the conflicting criteria are tested in advance mechanically by the gauging opening 10 and by the template 13 and the defective fasteners are removed from the conveyor. Accordingly, testing criteria monitored by the shank sensor 21, 22 or 23, 24 are limited to the following ones: shank diameter too small, shank length too short, and defects in the thread, in material or in the upper surface. The reliability of the sorting device can be further improved by arranging several pairs of sensing coils or plates one above the other along the shank of the tested fastener.

Figure 4:
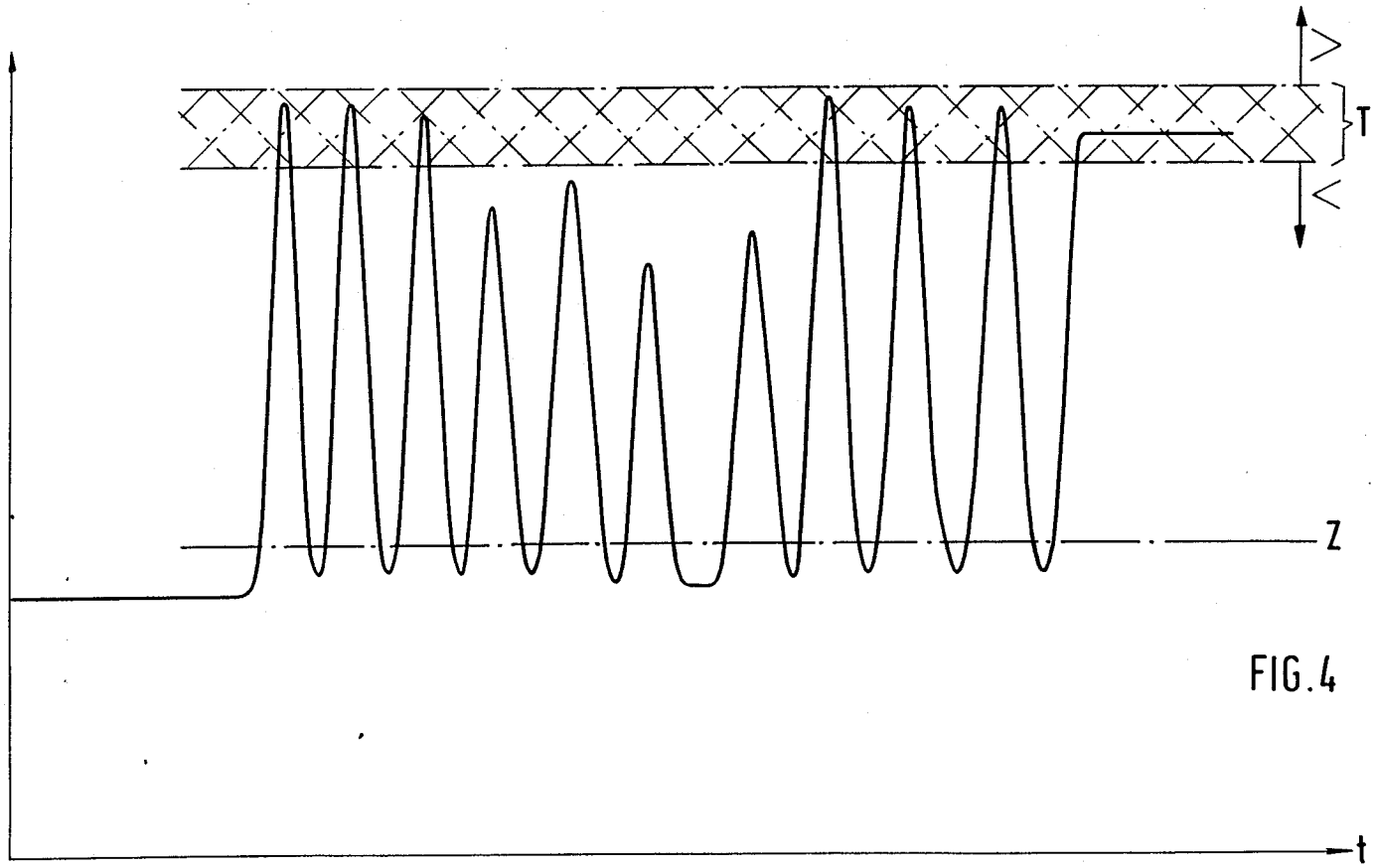
FIG. 4 is a time plot of an example of an output signal from the shank sensor of FIG. 4.

As seen from FIG. 4, the shank sensor 21, 22 in addition to the amplitude of the test signal, monitors also the serial number of counting pulses Z generated during the passage of each screw through the sensor. If the amplitude measuring signal is outside the acceptable tolerance range T then another signal is assigned to the corresponding counting pulse Z of this screw and the screw is conveyed as far as to the separating block 30. A head sensor 25 arranged in the separating block records the consecutive or serial numbers of the counting pulses. If it detects a serial number to which an error signal is assigned, it ejects the corresponding screws on a transverse slider 38 for defective screws. The comparison of the consecutive counting pulses with the assigned error signals and the generation of the ejection signal is preferably performed by a non-illustrated control device.

Figure 5:
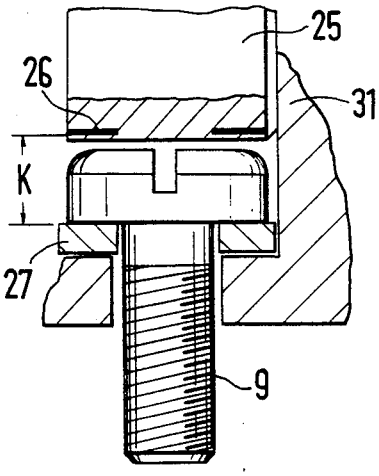
FIG. 5 shows a cross-sectional view of a head sensor in the device of FIG. 1.

The head sensor 25 is mounted fixed distance K above the rail 6 of the transfer fork 27 (FIG. 5). The coil 26 installed in the head sensor 25 also operates on the same principle disclosed in the aforementioned German patent application No. P 37 06 574.2, namely on sensing eddy-currents. The head sensor 25 identifies the following defects: the height of the head too low (a height of the head too high is identified by the template 13), a diameter of the head too large (too small diameter of the head is identified by the gauge 10), missing stamped out recesses or power application surfaces (such as for example, a slot instead of a torque surface, a missing slot and upper surface defects). As mentioned before, the head sensor also counts or registers the counting pulses. Defective screws, similarly as in the shank sensor 21, 22, are identified by measuring signals which exceed or fall short of a predetermined tolerance range (FIG. 4). The output signal of the sensor 25 also activates the transfer slider 38 for the defective screws.

The conveyor rail 6 terminates a short distance before the head sensor 25 and transits continuously into the transfer fork 27 of a transverse slider 28 which moves in a grading gate 29 of the separating block 30. The guiding gate 29 is inclined relative to the path of movement of a separating slider 31 which moves at right angles to the rail 6 and transfers the tested screws into a feed hole 32. Due to sliding movement of the separating slider 31, the slider 28 is moved in the guiding gate 29 and is progressively withdrawn (to the right in FIG. 1), the screw is set free and falls through the opponent hole 32 into one of the transverse sliders 34 through 38. On the indicated tarret plate 44 up to twelve transfer sliders 34–38 can be installed.

Figure 6:
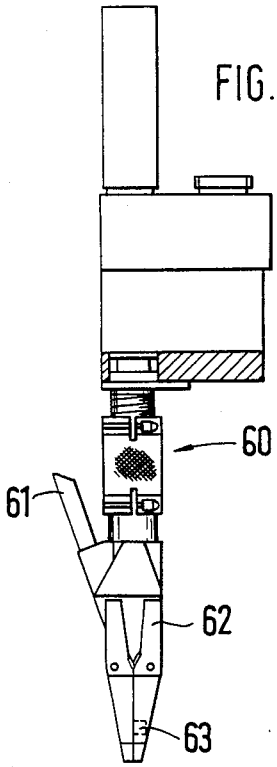
FIG. 6 shows an elevational view of a screw spindle for use in connection with the device of this invention.

Each of the transfer sliders includes a housing 39 for guiding a piston 40. The piston is connected via a piston rod 41 to a head piece 42 formed with an opening 43. In each opening 43 there is arranged a non-illustrated pneumatic hose through which the separated screws are fed either for packing or via pneumatic hoses 61 into a screw spindle 60 as illustrated in FIG. 6.

In order to control the separating device 3, the gripper chucks 62 of the screw spindle 60 are provided with sensors 63 such as for example eddy-current sensors which deliver either a signal "a screw present in the gripper" or "no screw present in the gripper" to the separating device 3.

Referring to FIG. 7, the regulating device 50 for the sorting device of this invention has an input connected to the proximity sensor 20 and an acknowledgment input connected to an actuator of the supply container 1 to indicate working state of the latter (on/off). The signal from the sensor 20 passes through a preparation stage 51 into a time control stage 52 having two outputs. One of the outputs switches on or off the actuator of the supply container 1, and the other output controls the switch-over of the slider 12 in such a manner that the rail piece 17 or 16 which is in alignment with the linear track 2 is ejected from the gap in the rail 6 and the other rail piece 16 or 17 is placed into alignment with the track 2.

While the invention has been illustrated and described as embodied in specific example of a sorting device for screws, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. A device for sorting fasteners defining a head and a shank, particularly screws, comprising a conveying device including a linear track for imparting to a series of said fasteners a rectilinear movement in a feeding direction; a plurality of mechanical and electrical gauging stations arranged one after the other in the rectilinear path of movement of said fasteners to detect deviations of the heads and shanks thereof from a predetermined fastener; said mechanical gauging stations preceding said electrical gauging stations; means for selectively removing said fasteners from said linear track in response to said gauging stations; and further comprising a proximity sensor for detecting fasteners fed on said linear track, said conveying device including a supply container having means for introducing said series of fasteners on said linear track and generating corresponding acknowledgment signals, and a regulating device for controlling said removing means in response to control signals at the output of said proximity sensor and to said acknowledgment signals.

2. A sorting device as defined in claim 1, wherein said proximity sensor operates on the eddy current principle.

3. A sorting device as defined in claim 1, wherein said regulating device includes an input stage for processing said control and acknowledgment signals, and a time control stage having an output for switching on and off said supply container and another output for activating said removing means.

4. A sorting device as defined in claim 3, wherein said regulating device inactivates said supply container in response to jamming of said fasteners on said track detected by said proximity sensor.

5. A sorting device as defined in claim 3, wherein said removing means includes an ejection slider and said regulating device upon detection of the jamming of said fasteners activates said ejection slider.

6. A sorting device as defined in claim 3, wherein said regulating device upon the detection of a prolongated absence of screws on said proximity sensor actuates said supply container.

7. A device for sorting fasteners defining a head and a shank, particularly screws, comprising a conveying device including a linear track for imparting to a series of said fasteners a rectilinear movement in a feeding direction; a plurality of mechanical and electrical gauging stations arranged one after the other in the rectilinear path of movement of said fasteners to detect deviations of the heads and shanks thereof from a predetermined fastener; said mechanical gauging stations preceding said electrical gauging stations; means for selectively removing said fasteners from said linear track in response to said gauging stations; said linear track including a slotted rail coupled to a vibrator for imparting to said fasteners said rectlinear movement in the feeding direction; and wherein one of said mechanical gauging stations consists of a gauging hole in said slotted rail of the linear track, said hole being slightly smaller in diameter than a predetermined diameter of heads of tested fasteners so that fasteners with a smaller head diameter fall through the gauging hole into a collecting container.

8. A sorting device as defined in claim 7, wherein a subsequent mechanical gauging station is a template for passing through predetermined fasteners but for stopping fasteners whose head is too high, whose head diameter is too large, whose shank diameter is too large, whose shank is too long and whose counter deviates from the predetermined fastener.

9. A sorting device as defined in claim 8, wherein an ejection slider is provided immediately at the entrance of said template to eject from said linear track those fasteners which have been stopped by said template.

10. A sorting device as defined in claim 9, wherein an electrical gauging station is a shank sensor arranged on said linear track in the range of the shanks of the conveyed fasteners to generate measuring signals indicative of defective or predetermined shanks.

11. A sorting device as defined in claim 9, wherein a subsequent electrical gauging station is a head sensor arranged above said slotted rail of the linear track to detect defective heads of the fasteners and to deliver a control signal for ejecting the defective fasteners.

12. A sorting device as defined in claim 11, wherein said shank sensor and said head sensor operate on the eddy current principle.

13. A sorting device as defined in claim 12, wherein a separating device is arranged at the end of said linear track for separating defective fasteners from the predetermined ones and for delivering the predetermined fasteners to a packing device or to a screw spindle.

14. A sorting device as defined in claim 13, wherein said separating device includes a plurality of transfer members, one of said transfer members being activated in response to control signals from said electrical gauging stations to remove the detected defective fasteners.

15. A sorting device as defined in claim 14, wherein said head and shank sensors generate respectively count pulses.

16. A sorting device as defined in claim 15, wherein upon detection of a defective fastener by said shank sensor an error signal is assigned to the corresponding count pulse.

17. A sorting device as defined in claim 16, wherein said separating device includes a control device which records the counting pulses of said head and shank sensors and activates said transfer member, preferably a transfer slider, for removing a fastener when said head sensor receives a count pulse with an assigned error signal.

18. A sorting device as defined in claim 13, wherein said standard fasteners sorted by said separating device are supplied to a screw driving spindle having gripper chucks provided with a sensor which delvers a control signal when a fastener is clamped in said gripper chucks.

* * * * *